US010532881B2

(12) United States Patent
Bodet et al.

(10) Patent No.: US 10,532,881 B2
(45) Date of Patent: Jan. 14, 2020

(54) PROCESS FOR MANUFACTURING AN AEROSOL VALVE AND AEROSOL VALVE

(71) Applicant: LINDAL FRANCE SAS, Briey (FR)

(72) Inventors: Hervé Bodet, Verdun (FR); Bernard Borel, Mancieulles (FR)

(73) Assignee: LINDAL FRANCE SAS, Val-de-Briey (FR)

( * ) Notice: Subject to any disclaimer, the term of this patent is extended or adjusted under 35 U.S.C. 154(b) by 0 days.

(21) Appl. No.: 15/580,160

(22) PCT Filed: Jun. 13, 2016

(86) PCT No.: PCT/EP2016/063537
§ 371 (c)(1),
(2) Date: Dec. 6, 2017

(87) PCT Pub. No.: WO2016/202754
PCT Pub. Date: Dec. 22, 2016

(65) Prior Publication Data

US 2018/0134481 A1 May 17, 2018

(30) Foreign Application Priority Data

Jun. 16, 2015 (FR) ..... 1555497

(51) Int. Cl.
*B65D 83/48* (2006.01)
*B65D 83/38* (2006.01)
*B65D 83/20* (2006.01)

(52) U.S. Cl.
CPC ..... *B65D 83/48* (2013.01); *B65D 83/207* (2013.01); *B65D 83/38* (2013.01)

(58) Field of Classification Search
CPC ..... B65B 83/48; B65D 83/38; B65D 83/207
See application file for complete search history.

(56) References Cited

U.S. PATENT DOCUMENTS

2008/0093393 A1 4/2008 Kim
2011/0101036 A1* 5/2011 Wanbaugh ..... B05B 11/3047 222/402.1

(Continued)

FOREIGN PATENT DOCUMENTS

EP 0 484 714 A1 5/1992
EP 2 216 267 A2 8/2010
FR 2 508 136 A1 12/1982

OTHER PUBLICATIONS

International Search Report and Written Opinion dated Jul. 18, 2016 issued in corresponding application No. PCT/EP2016/063537; w/ English partial translation and partial machine translation (21 pages).

(Continued)

*Primary Examiner* — J C Jacyna
(74) *Attorney, Agent, or Firm* — Seckel IP, PLLC

(57) ABSTRACT

A cup/valve assembly for an aerosol container, made up of a cup, a valve body, a stem, a spring, and an inner seal. The stem comprises a bulge on its outer cylindrical face and an inner conduit which has an upper opening at its upper end and at least one lateral orifice at its lower end between the bulge and the upper opening of the inner conduit. The valve body has an opening at its upper end. The valve body is fixed to a central opening (23) of the cup leaving the opening in the cylindrical portion free, and the stem is retained in the valve body by a retaining ring (5) that surrounds, without tightening, the stem, and is fixed to the cup, the inner seal (13) being interposed between the retaining ring (5) and the top edge of the cylindrical portion of the valve body.

19 Claims, 3 Drawing Sheets

(56) References Cited

U.S. PATENT DOCUMENTS

| | | | | |
|---|---|---|---|---|
| 2015/0197392 | A1* | 7/2015 | Franz | B65D 83/48<br>222/402.1 |
| 2016/0152404 | A1* | 6/2016 | Hawthorne | B65D 83/20<br>222/153.09 |

OTHER PUBLICATIONS

International Preliminary Report on Patentability dated Dec. 19, 2017 in corresponding application No. PCT/EP2016/063537; w/ English translation (13 pages).

* cited by examiner

PROCESS FOR MANUFACTURING AN AEROSOL VALVE AND AEROSOL VALVE

BACKGROUND ART

The invention relates to a cup/valve assembly for an aerosol container made up of a cup, a valve body, a stem, a spring, an inner seal, and means for retaining the stem in the valve body. The cup has at its center an opening through which the stem protrudes. The stem comprises a bulge on its outer cylindrical face and an inner conduit having an upper opening at its upper end and at least one lateral orifice at its lower end, the lateral orifice or orifices being placed between the bulge and the upper opening of the inner conduit. The valve body has a cylindrical portion provided with an opening at its upper end defining a top edge. The invention also relates to a method for manufacturing such a cup/valve assembly.

Cup/valve assemblies as described in the preamble are well known. They are generally constituted by an aluminum cup which is set by flaring on the upper crown of a valve body so as to enclose a portion of the stem in the valve body. These assemblies are commonly used and pose the problem of recycling used aerosols. Indeed, the stem and the valve body are generally plastic, while the cup and the spring are metallic.

SUMMARY OF THE INVENTION

The objective of the invention is to simplify the recycling of such cup/valve assemblies. Another objective is to simplify their manufacture.

These objectives are achieved according to the invention in that:

- the valve body is fixed to the opening of the cup by fixing means, leaving the entire opening of the cylindrical portion free,
- the portion of the stem that extends from the bulge to the end opposite the inner conduit is located inside the valve body, bearing against the spring,
- the means for retaining the stem in the valve body are constituted by a retaining ring that surrounds, without tightening, the portion of the stem located between the lateral orifice or orifices and the upper opening of the conduit, the outer diameter of the retaining ring being greater than the diameter of the opening and the inner diameter of the retaining ring being smaller than the diameter of the bulge of the stem, the retaining ring being fixed to the cup by fixing means, the inner seal being interposed between the retaining ring and the top edge of the cylindrical portion of the valve body so that, in the closed position of the valve, the inner seal fits tightly around the stem in the area of the lateral orifice or orifices and obstructs them, and so that the spring pushes the stem back and places its bulge bearing against the seal. By fixing the valve body on the cup so as to leave the entire opening free, it is possible to insert the stem, and notably its bulge, into the valve body after fixing the valve body on the cup. The means for retaining the stem are therefore not constituted by the cup, as is traditionally done, but by a retaining ring, separate from the cup, which is fixed on the cup after insertion of the stem into the valve body.

To prevent the retaining ring from protruding above the cup, preferably, said ring is placed in a recess provided on the upper face of the cup and that surrounds the opening. The height of the recess and that of the retaining ring can be selected so that, after fixation of the latter, its upper face is flush with the upper face of the cup or is set back from it. The bottom of the recess preferably forms a radial annular surface against which the retaining ring comes to bear.

To facilitate assembly of the cup/valve assembly, it is preferable to provide means for centering the retaining ring relative to the cup. These centering means can be constituted by a crown placed on the face of the retaining ring oriented toward the cup, preferably at its periphery. This crown is dimensioned to penetrate into a recess located on the cup and surrounding and/or surmounting the opening, preferably into a groove formed in the bottom of a recess. In order to facilitate the centering, preferably, the recess widens in the direction of the retaining ring, at least in its upper portion. In addition to or instead of a widening of the recess, it can also be provided that the crown narrows in the direction of the cup, at least in its lower portion. The bottom of the recess can form a radial annular surface against which the crown of the retaining ring bears. An extra thickness of material can be provided on the crown of the retaining ring or in the groove of the cup to serve as a weld seam.

In a first embodiment, the means for fixing the valve body to the opening of the cup are constituted by bridges placed between the outer face of the cylindrical portion of the valve body and the opening of the cup, said means for fixing the valve body being designed so that the top edge of the cylindrical portion of the valve body is located lower than the interface between the retaining ring and the cup at the level of the opening of the cup.

In another variant, the means for fixing the valve body to the opening of the cup are constituted by snapping means for snapping the valve body on the cup, the snapping means being designed so that the top edge of the cylindrical portion of the valve body is located lower than the interface between the retaining ring and the cup at the level of the opening of the cup. In both variants, if the retaining ring is fixed in a recess, the top edge is located lower than the bottom of the recess at the level of the opening of the cup.

A simple solution for fixing the retaining ring is to weld it onto the cup. For this purpose, an extra thickness of material can be provided on the retaining ring or on the cup to serve as a weld seam. The retaining ring can be provided with a crown on its lower face, preferably at its periphery, and the recess can be provided with an annular groove having dimensions corresponding to those of the crown of the retaining ring, wherein an extra thickness of material can be provided on the crown of the retaining ring or in the groove of the cup to serve as a weld seam.

In order to attach a dip tube, a metering reservoir, anti-sagging means or any other similar device, it may be useful to provide the valve body with a tube placed in the extension of the cylindrical portion, opposite the upper opening, a passage opening being provided to put in contact the inside of the tube and the inside of the cylindrical portion.

A pouch can be fixed on the valve body. Similarly, the cup can be provided with means for fixing it on the neck of a housing in order to form an aerosol container.

In order to allow easy recycling of the cup/valve assembly, the cup, the valve body, the stem and/or the retaining ring can be made in a thermoplastic material, and the spring in stainless steel or a thermoplastic material.

The invention also relates to a process for manufacturing a cup/valve assembly according to the invention. This process comprises the following steps:

(a) preparing a cup/valve body unit by fixing, using fixing means, the valve body in the central opening of the cup so that the upper opening of the cylindrical portion remains free;
(b) placing the seal on the portion of the stem located between the bulge and the upper opening;
(c) introducing the spring into the valve body;
(d) introducing into the valve body the portion of the stem that extends from the bulge to the end opposite the upper opening, until it bears against the spring;
(e) positioning a retaining ring on the portion of the stem located between the upper opening of the conduit and the lateral orifice or orifices or between the upper opening of the conduit and the seal if it is already mounted;
(f) lowering the retaining ring until it comes in contact with the upper face of the cup and surrounds the opening and blocks the inner seal between the retaining ring and the top edge of the cylindrical portion of the valve body so that, in the closed position of the valve, the seal fits tightly around the stem in the area of the lateral orifice or orifices and obstructs them and so that the spring pushes the stem back and places its bulge bearing against the seal;
(g) fixing the retaining ring on the ring;

the order of steps (a) to (e) not being fixed, except that step (d) is performed after step (c).

To simplify the process, it will be possible to provide:

in step (a), molding together as a single piece the cup and the valve body, the valve body being connected to the cup preferably by bridges in the area of the opening; or in step (a), snapping the valve body onto the cup using snapping means.

Similarly, it is preferable, in step (e), to mold together as a single piece the stem and the retaining ring, the retaining ring being connected to the stem by bridges that can break easily, the retaining ring being located between the orifices and the upper opening of the inner conduit.

Finally, it is preferable, in step (g), to fix the retaining ring on the cup by welding, and further, an extra thickness of material can be provided on the retaining ring or on the cup to serve as a weld seam.

BRIEF DESCRIPTION OF THE DRAWINGS

The invention is explained in more detail below with the help of the following Figures.

DETAILED DESCRIPTION OF PARTICULAR EMBODIMENTS

The valve of the invention is intended to be made entirely in plastic in order to allow easier recycling of the aerosol container after use. It is self-evident that some parts may however be made in another material, for example, metal.

Figure 1:
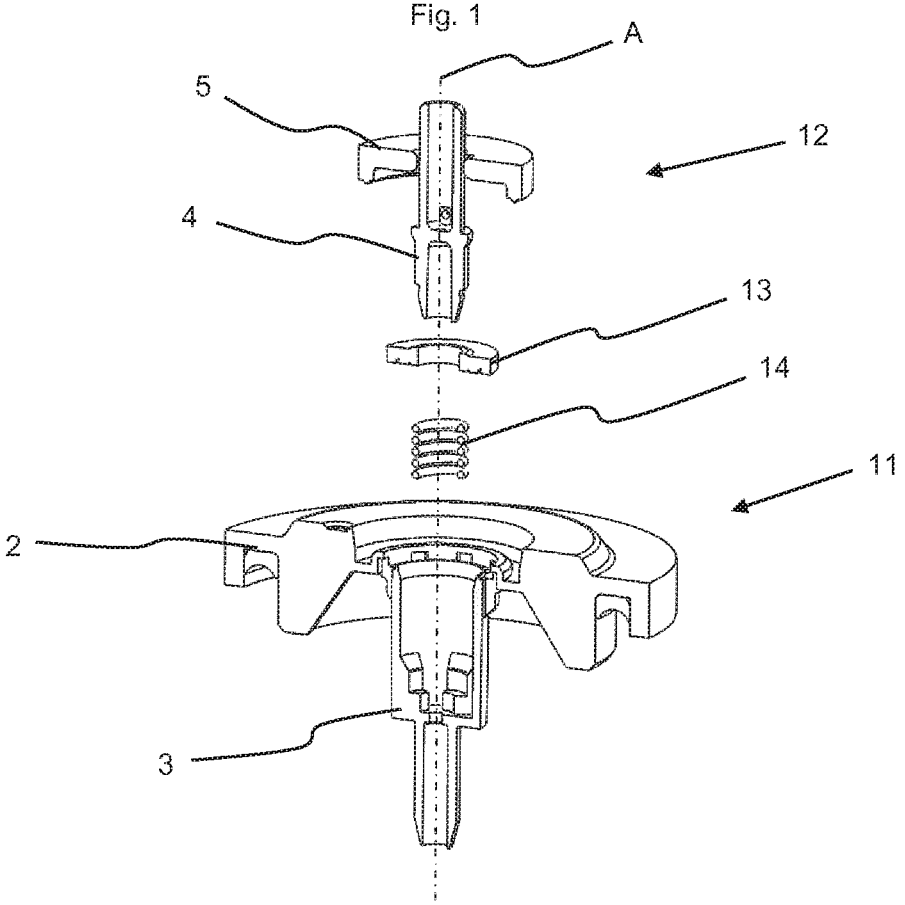
FIG. 1: exploded cross-sectional view of the various elements constituting the valve.

The invention relates to a cup/valve assembly (1) made up, as shown in FIG. 1, of a cup unit (11) constituted by a cup (2) and a valve body (3), a stem unit (12) constituted by a stem (4) and a retaining ring (5) for fixing the stem in the valve body (3), an inner seal (13), and a spring (14).

These parts all have a certain symmetry of rotation about an axis (A) passing through the center of the stem (4) and marked schematically in FIG. 1. The adjectives "radial" and "axial" refer to this axis. In addition, spatial references such as "above" or "below" refer to the position shown in the figures. It is self-evident that the cup/valve assembly of the invention can be used in other positions, including upside down, in which case, what was described as "above" or "below" would be found in the opposite position.

The cup unit (11) combines in a single piece the cup (2) and the valve body (3). It would of course be possible to produce this unit in the form of two separate parts assembled together by any appropriate means, for example, by snapping. The cup conventionally comprises a peripheral edge (21) to attach it to the neck of a housing (6) after interposition, if appropriate, of an outer seal (22). The lower face of the cup can be provided with reinforcing ribs (25).

The cup has in its center an opening (23) that is surrounded, on the upper face of the cup, by a recess (24) concentric with the opening (23). In the embodiment shown here, the bottom of the recess has an annular groove (241).

The valve body (3) is fixed to the cup in the area of the opening (23). It is constituted essentially by a cylindrical element (31) open at the top and closed at the bottom by a radial partition wall (32). The cylindrical element is extended by a tube (33) fixed to the radial wall. An opening (34) is provided in the radial wall to put in contact the inside of the cylinder and the conduit located inside the tube. L-shaped radial ribs (35) are placed in the bottom of the cylindrical element (31). The vertical branches of the L serve to guide the spring (14) while the horizontal branches serve to support it. The horizontal branches of the L do not touch one another. In the example presented, they stop at a distance from the orifice (34). The cylindrical element (31) is connected to the cup (2) by bridges (36) made in the upper portion of its outer face. These bridges are distributed regularly over the periphery of the cylindrical element and form crenellations projecting radially outwards and upwards. The upper portions of these bridges are connected to the wall of the opening (23). On its top edge, the cylindrical element (31) has an annular rib (37) in order to ensure sealing with the inner seal (13). The top of the annular rib (37) is located lower than the bottom of the recess (24) at the level of the opening (23). It is possible, however, to provide that the bottom of the recess in the area of the annular groove (241) is at the same level, or even lower, than the top of the annular rib (37). It would also be possible to replace the bridges (36) by a continuous attachment.

The stem unit (12) is constituted by a stem (4) and a retaining ring (5). To simplify manufacture and assembly, it is preferable to provide that the stem unit is made as a single piece. For this purpose, the retaining ring and the stem are molded together and connected by a few weak bridges (51) that break easily during assembly. It would of course be possible to manufacture the two elements separately.

The stem (4), as the rod is called, is constituted by a tubular element separated at its center by a radial wall (41) forming an upper conduit (42) and a lower conduit (43). One or several orifices (44) are made in the bottom of the upper conduit, near the radial wall (41), in order to put the inside of this upper conduit in contact with the cylindrical outer face of the stem. An annular bulge (45) is formed on the cylindrical outer face of the stem, below the orifices (44). This bulge (45) is flattened on the side of the orifices (44) so as to form a radial bearing surface (46). In the example presented here, the bulge (45) is in the extension of the partition wall (41). The lower conduit (43) has no function, and the portion of the tubular element located below the radial partition (41) could be full. It serves as guiding tenon in the spring (14). An annular shoulder (47) is formed in the tenon, which, in the mounted state, acts as a stop for the spring.

The retaining ring (5) has the shape of a round plate pierced at its center so as to form a passage (52). The outer diameter of the retaining ring is slightly smaller than the diameter of the recess (24), and in any case greater than the diameter of the opening (23). The diameter of the passage (52) is slightly greater than the outside diameter of the wall of the upper conduit (42) of the stem. On its lower face, an extra thickness of material (53) having an annular shape can be placed to serve as a weld seam during assembly. In the example presented here, the weld seam is placed on a crown (54) placed at the periphery of the lower face of the retaining ring. This ring penetrates into the annular groove (241) formed in the recess (24) of the cup. The crown can serve as centering means for centering the retaining ring as it is moved in the direction of the cup during assembly. If the retaining ring is not provided with such a crown, it is not necessary to provide an annular groove in the recess. The bridges (51) that connect the stem and the retaining ring before assembly are located between the orifices (44) and the top of the stem, for example, about halfway.

The inner seal (13) is an annular flat seal whose outer diameter is slightly smaller than or equal to the diameter of the opening (23) at the junction between the cup and the valve body, and greater than the diameter of the annular rib (37) at the top of the valve body. Its inner diameter is equal to or slightly smaller than the diameter of the stem at the orifices (44).

Figure 3:
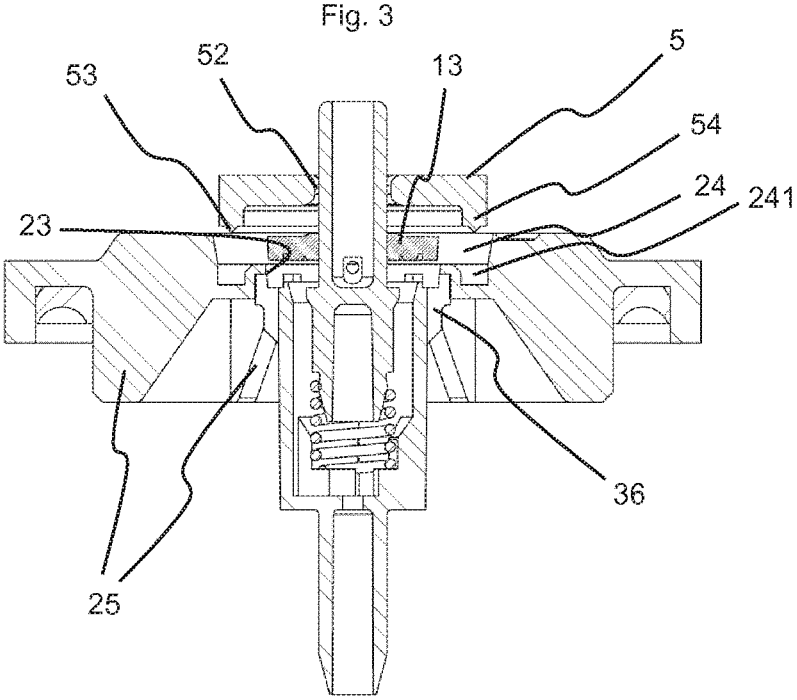
FIG. 3: cross-sectional view of the valve before welding of the retaining ring.

When assembling the cup/valve assembly, a spring (14) is introduced into the valve body (3) so that it is located in the space defined by the vertical branches of the ribs (35), bearing on the horizontal branches of these ribs. In parallel, the inner seal (13) is slid over the lower portion of the stem serving as tenon until it has passed over the bulge (45). For this purpose, the lower face of the bulge is inclined to facilitate the passage of the seal. The latter is then located between the bulge (45) and the retaining ring (5) which is still fixed to the upper portion of the stem. The stem/retaining ring unit provided with the seal is then introduced into the valve body until the lower portion of the stem penetrates into the spring and the upper end of the spring comes into contact with the annular shoulder (47) of the lower portion of the stem. This situation is shown in FIG. 3.

Figure 2:
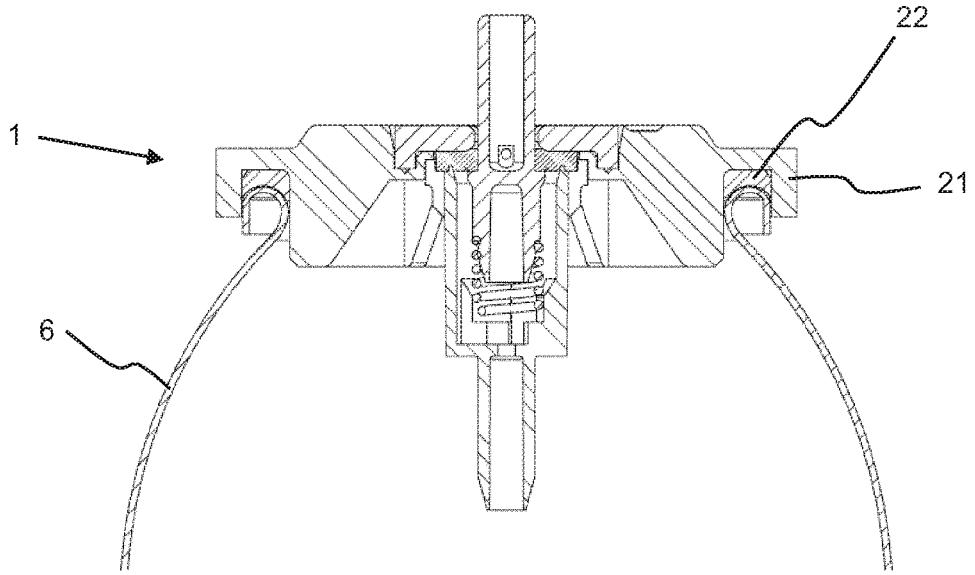
FIG. 2: cross-sectional view of a cup/valve assembly according to the invention mounted on a housing for producing an aerosol container.
Figure 4:
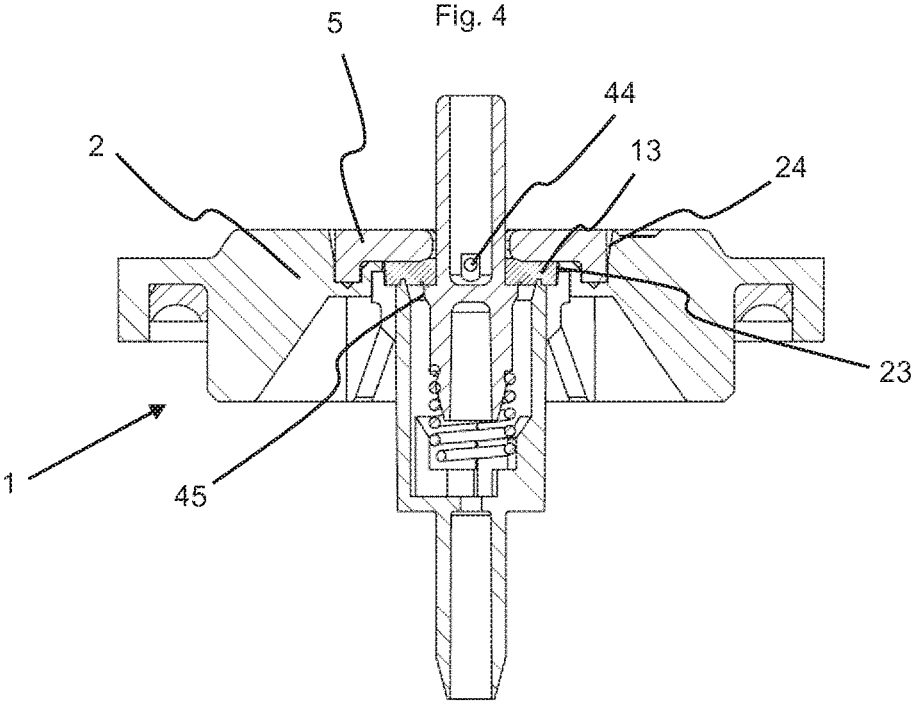
FIG. 4: cross-sectional view of the valve after welding of the retaining ring.
Figure 5:
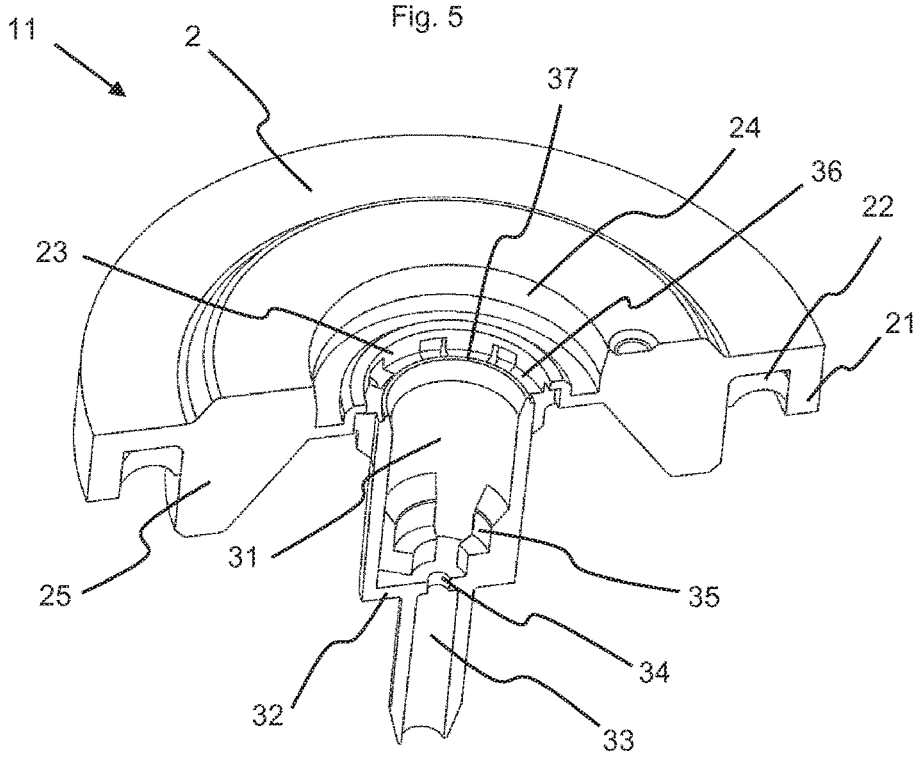
FIG. 5: cross-sectional and perspective view of the cup unit before assembly.
Figure 6:
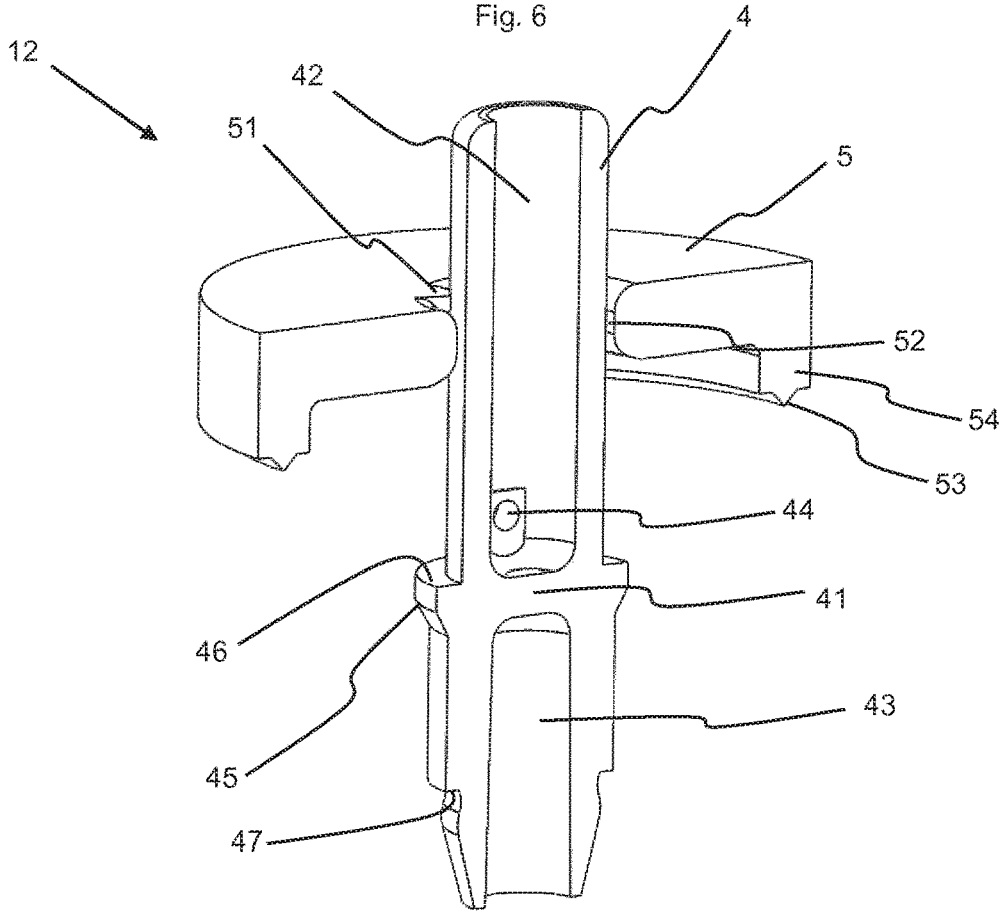
FIG. 6: cross-sectional and perspective view of the stem unit before assembly.

The retaining ring is then pushed down and the bridges (51) which connected it to the stem (4) break. The ring is brought into contact with the cup. It takes position in the recess (24) with its extra thickness of material (53) bearing against the annular radial surface forming the bottom of the recess (24), as the case may be, in the annular groove (241) when there is one as is the case in this example. While moving down, the retaining ring pushes the seal (13) downwards so that it comes to be pressed against the annular rib (37) formed on the top edge of the cylindrical element (31) of the valve body. The seal is thus wedged between the lower face of the retaining ring and, firstly, the radial bearing surface (46) of the bulge, and secondly, the annular rib (37) of the valve body. It is then possible to weld the retaining ring on the cup, for example, by ultrasound. This is the situation shown in FIG. 4. In this position, the stem is subjected to the pressure of the spring (14) which tends to push it upwards, but it is retained by its bulge (45) which abuts against the seal, which in turn bears against the retaining ring (5). The cup/valve assembly is ready to be mounted on a housing to form an aerosol container (see FIG. 2).

When the retaining ring (5) is provided with an annular ring (54) that penetrates into a groove (214) of the recess (24), preferably, the lateral wall or walls of this recess are slightly inclined relative to the vertical, at least in their upper portions, so that the recess widens toward the top, at least in its upper portion. Thus, when the retaining ring (5) is lowered toward the cup during assembly, its crown is guided into the recess (24) by the inclined side wall or walls, even if the retaining ring is not exactly coaxial with the recess (24). It would also be possible to incline the side wall or walls of the annular crown (54) in addition to or instead of the inclination of the lateral wall or walls of the recess (24), so that the crown would be narrower at its free end oriented toward the cup (2) than at its base attached to the plate of the retaining ring. In the example presented here, the recess (24) is essentially constituted by an upper portion intended to receive the main plate of the retaining ring (5) and delimited by an outer lateral wall, and further, by a lower portion constituted by the groove (241) intended to receive the crown (54) of the retaining ring and delimited by two lateral walls and a bottom wall, the outer lateral wall of the groove being in the extension of the lateral wall of the upper portion in this case. The lateral wall of the upper portion of the recess (24) is slightly inclined relative to the vertical so that the recess widens toward the top, as is clearly visible in FIGS. 3 and 4. It would also be possible to provide only one groove (241) serving as a recess for the crown (54), without a recess for the main plate of the retaining ring (5). In this case, one or both lateral walls could be inclined relative to the vertical, at least in their upper portions, so that the groove would widen toward the top.

A flexible pouch could be attached to the valve body (3) to form a valve/pouch assembly. For this purpose, two opposite fins can be provided on the valve body to facilitate welding of the pouch. Due to the pressing of the seal at the annular rib (37) at the top of the valve body, the inside of the valve body is isolated from the space surrounding the valve body, that is to say, the space located between the housing and the flexible pouch.

The various elements are preferably made in a plastic material. For example, a thermoplastic material can be selected for the cup unit and for the stem unit and stainless steel or a thermoplastic material for the spring. The housing must be in a material compatible with that of the cup if the cup/valve assembly is to be welded on it. For example, PET can be selected.

The advantage of the cup/valve assembly of the invention is that all the parts can be made in plastic, including the spring, which facilitates the recycling of the aerosol container after use. Moreover, by molding as a single piece, firstly, the cup unit, and secondly, the stem unit, the number of pieces is considerably reduced, which makes it possible to save space during storage and to reduce assembly costs.

LIST OF REFERENCES

1 Cup/valve assembly
11 Cup unit

12 Stem unit
13 Inner seal
14 Spring
2 Cup
21 Peripheral edge
22 Outer seal
23 Opening
24 Recess
241 Annular groove
25 Reinforcing ribs
3 Valve body
31 Cylindrical element
32 Radial partition wall
33 Tube
34 Passage opening
35 Radial ribs
36 Bridges
37 Annular rib
4 Stem
41 Radial wall
42 Upper inner conduit
43 Lower inner conduit
44 Orifices
45 Annular bulge
46 Radial bearing surface
47 Annular shoulder
5 Retaining ring
51 Bridges
52 Passage
53 Extra thickness of material
54 Annular crown
6 Aerosol housing

The invention claimed is:

1. Cup/valve assembly for an aerosol container, the assembly comprising a cup, a valve body, a stem, a spring, an inner seal and means for retaining the stem in the valve body, the cup having at a center thereof an opening through which the stem protrudes, the stem comprising a bulge on its outer cylindrical face and an inner conduit having an upper opening at an upper end thereof and at least one lateral orifice at a lower end thereof, the lateral orifice or orifices being placed between the bulge and the upper opening of the inner conduit, the valve body having a cylindrical portion provided with an opening at an upper end thereof defining a top edge, wherein the valve body is fixed to the opening of the cup, leaving the opening of the cylindrical portion free, the portion of the stem that extends from the bulge to the end opposite the inner conduit is located inside the valve body, bearing against the spring, the means for retaining the stem in the valve body are constituted by a retaining ring that surrounds, without tightening, the portion of the stem located between the lateral orifice or orifices and the upper opening of the conduit, an outer diameter of the retaining ring being greater than a diameter of the opening of the cup and an inner diameter of the retaining ring being smaller than a diameter of the bulge of the stem, the retaining ring being fixed to the cup, the inner seal being interposed between the retaining ring and the top edge of the cylindrical portion of the valve body so that, in the closed position of the valve, the inner seal fits tightly around the stem in the area of the lateral orifice or orifices and obstructs the lateral orifice or orifices, and the spring pushes the stem back and places the bulge bearing against the seal, wherein centering means are provided to facilitate the centering of the retaining ring relative to the cup, wherein the centering means comprise a crown placed on the face of the retaining ring oriented toward the cup, the crown being dimensioned to penetrate into a recess located in the cup and surrounding the opening, wherein the crown penetrates in an annular groove formed by the recess.

2. Cup/valve assembly according to claim 1, wherein the retaining ring is placed in a recess provided on the upper face of the cup and that surrounds the opening.

3. Cup/valve assembly according to claim 1, wherein the valve body is fixed to the opening of the cup by fixing means, wherein the fixing means comprise bridges placed between the outer face of the cylindrical portion of the valve body and the opening of the cup, the fixing means being designed so that the top edge of the cylindrical portion of the valve body is located lower than the interface between the retaining ring and the cup at the level of the opening of the cup.

4. Cup/valve assembly according to claim 1, wherein the valve body is fixed to the opening of the cup by snapping the valve body onto the cup, so that the top edge of the cylindrical portion of the valve body is located lower than the interface between the retaining ring and the cup at the level of the opening of the cup.

5. Cup/valve assembly according to claim 1, wherein the retaining ring is fixed to the cup by welding.

6. Cup/valve assembly according to claim 1, wherein the valve body is provided with a tube placed in an extension of the cylindrical portion, opposite the upper opening, a passage opening being provided to put in contact the inside of the tube and the inside of the cylindrical portion.

7. Cup/valve assembly according to claim 1, wherein a pouch is fixed on the valve body.

8. Cup/valve assembly according to claim 1, wherein the cup is provided with means for fixing it on the neck of a housing in order to form an aerosol container.

9. Cup/valve assembly according to claim 1, wherein the cup and/or the valve body and/or the stem and/or the retaining ring are made in a thermoplastic material, and the spring is made in steel stainless steel or in a thermoplastic material.

10. Process for manufacturing a cup/valve assembly comprising a cup, a valve body, a stem, a spring, an inner seal and means for retaining the stem in the valve body, the stem comprising a bulge on an outer cylindrical face thereof and an inner conduit having an upper opening at an upper end thereof and at least one lateral orifice at a lower end thereof, the lateral orifice or orifices being placed between the bulge and the upper opening of the inner conduit, the valve body having a cylindrical portion provided with an opening at an upper end thereof in order to let in at least a portion of the stem that extends from the bulge and up to the lower end opposite the inner conduit, wherein the process comprises:

(a) preparing a cup/valve body unit by fixing the valve body in a central opening of the cup so that the upper opening of the cylindrical portion remains free;

(b) placing the seal on the portion of the stem between the bulge and the upper opening;

(c) introducing the spring into the valve body;

(d) introducing into the valve body the portion of the stem that extends from the bulge to the end opposite the upper opening, until it bears against the spring;

(e) positioning a retaining ring on the portion of the stem located between the upper opening of the conduit and the lateral orifice or orifices or between the upper opening of the conduit and the seal if the seal is already mounted;

(f) lowering the retaining ring until the retaining ring comes in contact with the upper face of the cup and surrounds the opening of the cup and blocks the inner seal between the retaining ring and a top edge of the cylindrical portion of the valve body so that, in the closed position of the valve, the seal fits tightly around the stem in the area of the lateral orifice or orifices and obstructs the lateral orifice or orifices, and so that the spring pushes the stem back and places the bulge bearing against the seal;

(g) fixing the retaining ring on the ring;

the order of steps (a) to (e) not being fixed, except that step (d) is performed after step (c), so as to obtain the cup-valve assembly according to claim 1.

11. Process according to claim 10, wherein, in step (a), the cup and the valve body are molded together as a single piece.

12. Process according to claim 10, wherein in step (a) the valve body is snapped onto the cup using snapping means.

13. Process according to claim 10, wherein, in step (e), the stem and the retaining ring are molded together as a single piece, the retaining ring being connected to the stem by bridges that can break easily, the retaining ring being located between the orifices and the upper opening of the inner conduit.

14. Process according to claim 10, wherein, in step (g), the retaining ring is fixed to the cup by welding.

15. Cup/valve assembly according to claim 1, wherein the retaining ring is fixed to the cup by fixing means.

16. Cup/valve assembly according to claim 2, wherein a height of the recess and a height of the retaining ring are selected so that, after fixation of the retaining ring on the cup, an upper face of the retaining ring is flush with an upper face of the cup or is set back therefrom.

17. Cup/valve assembly according to claim 5, wherein an extra thickness of material is provided on the retaining ring or on the cup to serve as a weld seam.

18. Cup/valve assembly according to claim 1, wherein the recess widens in the direction of the retaining ring, at least in its upper portion, and/or the ring narrows in the direction of the cup, at least in its lower portion, and wherein an extra thickness of material is provided on the crown of the retaining ring or in the groove of the cup to serve as a weld seam.

19. Cup/valve assembly according to claim 1, wherein the annular groove is formed in a bottom of the recess.

* * * * *